US007441977B2

(12) United States Patent
Merzon

(10) Patent No.: US 7,441,977 B2
(45) Date of Patent: Oct. 28, 2008

(54) PORTFOLIO WITH REVERSIBLE ARTICLE RETAINING BOARD AND METHOD OF MAKING ARTICLE RETAINING POCKETS THEREFOR

(76) Inventor: Adam Merzon, 26 Memory La., Greenwich, CT (US) 06381

( * ) Notice: Subject to any disclaimer, the term of this patent is extended or adjusted under 35 U.S.C. 154(b) by 680 days.

(21) Appl. No.: 10/925,415

(22) Filed: Aug. 24, 2004

(65) Prior Publication Data

US 2005/0166545 A1 Aug. 4, 2005

(51) Int. Cl.

| | |
|---|---|
| ***B42F 13/00*** | (2006.01) |
| *B42D 3/00* | (2006.01) |
| *B42D 3/18* | (2006.01) |
| *B65D 73/00* | (2006.01) |

(52) U.S. Cl. ..... 402/73; 281/31; 281/51; 206/473; 206/478; 402/74

(58) Field of Classification Search ..... D19/26, D19/27; 402/72, 74, 75, 77, 78, 80 R, 80 P; 281/3.1, 4, 15.1, 16, 17, 29, 34, 51; 206/311, 206/312, 308.1, 473, 477, 478, 481, 483; 220/503, 507; 190/109, 110

See application file for complete search history.

(56) References Cited

U.S. PATENT DOCUMENTS

| | | | | | |
|---|---|---|---|---|---|
| 929,074 | A * | 7/1909 | Brown et al. | 190/16 |
| 1,980,683 | A * | 11/1934 | Herrmann | 190/109 |
| 2,879,774 | A * | 3/1959 | Siegel | 40/124.2 |
| 3,316,669 | A * | 5/1967 | Nachbar | 40/620 |
| RE26,395 | E * | 5/1968 | Schneider | 281/39 |
| 4,306,737 | A * | 12/1981 | Errichiello | 281/32 |
| 4,356,652 | A * | 11/1982 | Schneider | 40/530 |
| 5,350,249 | A * | 9/1994 | Peters | 402/4 |
| 5,351,992 | A * | 10/1994 | Chilson et al. | 281/31 |
| 5,396,987 | A * | 3/1995 | Temple et al. | 206/309 |
| 5,556,683 | A * | 9/1996 | Ranalli | 428/76 |
| 5,676,482 | A * | 10/1997 | Hawkins | 402/79 |
| 5,752,721 | A * | 5/1998 | Balbas | 281/19.1 |
| 5,797,630 | A * | 8/1998 | Conley, Jr. | 281/15.1 |
| 5,799,791 | A * | 9/1998 | Harley | 206/478 |
| 7,140,643 | B1 * | 11/2006 | Smith | 281/21.1 |
| 7,278,539 | B2 * | 10/2007 | Souza | 206/315.1 |
| 2003/0188942 | A1 * | 10/2003 | Scicluna | 190/111 |
| 2006/0011686 | A1 * | 1/2006 | Latham | 224/579 |

FOREIGN PATENT DOCUMENTS

JP 11342017 A * 12/1999

* cited by examiner

*Primary Examiner*—Pradeep C Battula
(74) *Attorney, Agent, or Firm*—Stephen Cannavale, Esq

(57) ABSTRACT

A portfolio including a panel and a removable and reversible article carrying board. The panel and board have a fastening arrangement, preferably a hook and loop fastener, for releasable engagement therebetween. The board preferably has at least one fastening arrangement located on each side. At least one fastening arrangement preferably extends outwardly beyond the board or panel to engage a fastening arrangement located on an away facing board or panel side. In a preferred embodiment, each board side has a fastener strip disposed along side edges and the panel has a pair of spaced apart outwardly extending fastener strips that each engages a fastener strip on the away facing board side and that also each engages a fastener strip on the toward facing board side. The board can include an expandable elastic pocket of bonded and preferably heat sealed construction.

19 Claims, 7 Drawing Sheets

PORTFOLIO WITH REVERSIBLE ARTICLE RETAINING BOARD AND METHOD OF MAKING ARTICLE RETAINING POCKETS THEREFOR

FIELD OF THE INVENTION

The present invention relates to portfolios, and more specifically to a portfolio having a reversible article holding board, article holding pocket therefor, and method of making such a pocket.

BACKGROUND OF THE INVENTION

In the past, portfolios, including those configured in binder form, have been equipped with storage pockets used to carry articles of all types, including storage media. However, especially with regard to storage media, holders used in such portfolios have been limited as they are designed to carry only one type or size of article.

In the past, in one known type of storage media holding portfolio used to hold magnetic storage media, the portfolio has stitched storage pockets. Each pocket has an outer pocket wall that is stitched to sidewalls and a bottom wall. Unfortunately, storage pockets of such stitched construction are expensive to make and labor intensive to produce, all of which increases production costs.

What is needed is a portfolio that is capable of holding more than one type or size of article. What is further needed is an article holding pocket construction that is faster and more economical to produce.

SUMMARY OF THE INVENTION

The present invention is directed to a portfolio that can be configured to comprise a binder that has an article carrying board that is releasably retained by the portfolio and which can be removed and reversed, preferably to enable either side of the board to be presented to a user of the portfolio. In one preferred embodiment, the article carrying board is constructed and arranged to removably carry one size or type of article on one side and another size or type of article on the other side.

The portfolio includes at least one panel, preferably a cover panel, to which the article carrying board is releasably attachable. The panel carries at least one fastening arrangement that releasably engages a corresponding fastening arrangement carried by the board. To enable the board to be reversed and releasably attached to the panel, each side of the board preferably carries such a fastening arrangement.

In a preferred embodiment, a fastening arrangement carried by the panel or the board extends outwardly beyond an edge of the panel or board and releasably engages a fastening arrangement carried by the other of the panel or the board. The outwardly extending fastening arrangement preferably wraps around an edge of the other of the panel or the board to releasably engage the fastening arrangement carried by the other of the panel or the board. In a currently preferred embodiment, the outwardly extending fastening arrangement extends outwardly from the panel and wraps around one edge of the board to releasably engage a fastening arrangement carried by the board.

In a currently preferred embodiment, the panel has a plurality of spaced apart fastening arrangements that each releasably engage a corresponding one of a plurality of spaced apart fastening arrangements disposed on each side of the board. When the board is releasably attached to the panel with one side of the board facing toward the panel, each one of the plurality of spaced apart fastening arrangements located on one side of the board releasably engage a corresponding one of the plurality of fastening arrangements of the panel. Preferably, each one of the plurality of fastening arrangements of the panel releasably engage a corresponding one of the plurality of fastening arrangements located on the side of the board facing toward the panel. To reverse the board, the board is detached from the panel and flipped around so the opposite side faces toward the panel. Thereafter, the board is brought toward the panel until each one of the plurality of fastening arrangements located on the side of the board facing toward the panel releasably engages a corresponding one of the plurality of fastening arrangements of the panel.

Each one of the plurality of fastening arrangements of the panel preferably has a first section that extends outwardly from the panel. When releasably attaching the board to the panel, at least a portion of each outwardly extending first fastening arrangement section releasably engages with a corresponding one of the plurality of fastening arrangements located on the side of the board facing away from the panel. Each one of the plurality of fastening arrangements of the panel preferably also has a second section that is attached to the panel. When releasably attaching the board to the panel, at least a portion of each outwardly extending second fastening arrangement section releasably engages with a corresponding one of the plurality of fastening arrangements located on the side of the board facing toward the panel.

In one preferred embodiment, each one of the plurality of fastening arrangements of the panel is comprised of a hook and loop fastening material and each one of the plurality of fastening arrangements located on each side of the board is comprised of a hook and loop fastening material of a complementary construction. For example, where the hook and loop fastening material of the panel is comprised of hooks, the hook and loop fastening material of each side of the board is comprised of loops. Of course, the order of use can be reversed, e.g., they are interchangeable.

Each one of the plurality of fastening arrangements located on each side of the board is preferably disposed adjacent to or along a side edge of the board. For example, in one preferred embodiment, one fastening arrangement of one side of the board is located along a side edge of the board and the other fastening arrangement of the one side of the board is located along an opposite side edge of the board. The same is true for the plurality of fastening arrangements located on the other side of the board.

Each one of the plurality of fastening arrangements located on the panel preferably is also disposed adjacent to or along a side edge of the panel. For example, in one preferred embodiment, one fastening arrangement of the panel is located along one side edge of the panel and the other fastening arrangement of the panel is located along the other side edge of the panel.

Each one of the plurality of fastening arrangements of the board and the panel preferably comprise strips of elongate construction. In one preferred embodiment, each fastening arrangement strip on each side of the board preferably extends substantially along one extent of the board. For example, where each fastening strip of each side of the board is disposed along or adjacent to a side edge of the board, each fastening strip preferably extends substantially the length of the board. Each fastening arrangement strip of the panel preferably is similarly constructed. If desired, each fastening arrangement strip can be of a continuous construction or be of intermittent construction. If desired, each fastening arrangement strip can be made up of a plurality or a plurality of pairs of spaced apart pieces of fastening arrangement material.

In one preferred embodiment, the panel has a fastening arrangement strip disposed along or adjacent to a pair of side edges of the panel such that the fastening arrangement strips are generally parallel. Disposed between the fastening arrangement strips are at least one and preferably a plurality of pieces of a fastening arrangement material. Each piece of fastening arrangement material preferably corresponds with and releasably engages a piece of fastening arrangement material located on the side of the board facing toward the panel when the board is releasably attached to the panel. In one preferred embodiment, one piece of fastening material is disposed adjacent to one side edge of the panel that is generally perpendicular to the side edges of the panel along which each one of the fastening arrangement strips run and another piece of fastening material is disposed adjacent the opposite side edge of the panel that is also generally perpendicular to the side edges of the panel along which each one of the fastening arrangement strips run. Each side of the board has pieces of a fastening arrangement material correspondingly located so as to releasably engage the aforementioned pieces of fastening arrangement material of the panel when that side of the board is facing toward the panel.

In a currently preferred embodiment, the portfolio has a plurality of panels with one of the panels movable relative to the other one of the panels. To permit relative panel movement, there is at least one hinge disposed between the panels. Preferably, a spine is disposed between the panels such that there is a first hinge interconnecting one of the panels and the spine and there is a second hinge interconnecting the other one of the panels and a spine. Such an arrangement preferably permits one of the panels to be folded over the other one of the panels.

Each panel preferably is constructed in accordance with that previously discussed such that each panel can releasably and reversibly hold an article holding board that also preferably is constructed in accordance with that previously discussed. Such a portfolio preferably has a plurality of such article holding boards.

Where the portfolio has a plurality of such panels hingably interconnected, one of the panels can be moved relative to the other one of the panels such that they overlie each other with the article holding board releasably attached to each panel disposed between the panels. Such a portfolio can be constructed with a cover panel that can be folded over one of the other panels. Such a cover panel preferably is releasably latchable to the panel over which it is folded to close the portfolio.

The portfolio can also be configured as a case, if desired. For example, each one of the board holding panels can be equipped with a skirt along opposite side edges that can be attached to an adjacent skirt of an adjacent panel using a zipper or the like when the panels are disposed so they overlie one another. Such a portfolio configuration can also include a cover panel of the aforementioned construction. Such a portfolio configuration can also comprise one or more binders or be configured as a binder.

At least one of the article carrying board is equipped with an article holding pocket on one side of the board that is constructed and arranged to hold one type or size of article and is equipped with an article holding pocket on the other side of the board that preferably is constructed and arranged to hold an article of a different type or size. In one preferred embodiment, the portfolio includes at least one article carrying board that is equipped with a plurality of article holding pockets on one side of the board that are each constructed and arranged to hold a storage media of a first type or size and that is equipped with a plurality of article holding pockets on the other side of the board that are each constructed and arranged to holding storage media of a second type or size. For example, in one preferred embodiment, the portfolio includes at least one article carrying board that has a plurality of pockets on one side of the board that are each constructed and arranged to hold a MiniDV cassette and that has a plurality of pockets on the other side of the board that are each constructed and arranged to hold an eight millimeter cassette. In a currently preferred embodiment, the portfolio includes a plurality of such article holding boards.

One preferred pocket arrangement is generally T-shaped in construction. The pocket arrangement includes an outer wall, a pair of sidewalls, and a bottom wall that, along with part of the board, define an article receiving cavity. Each sidewall and bottom wall preferably is of flexible and elastomeric construction. In one preferred embodiment, each sidewall and bottom wall is formed of a band of elastic material. Each sidewall and bottom wall extends outwardly from the outer wall and is attached a distance away from the outer wall to the board.

The outer wall preferably is made of a plurality of layers or sheets of material bonded to each other and part of each sidewall and the bottom wall. In one preferred construction, one end of each sidewall and the bottom wall is disposed between the layers and bonded thereto to form a bonded pocket assembly of durable and strong construction.

In one preferred embodiment, another layer or sheet of material is disposed between the plurality of layers or sheets that form the outer wall of the pocket. This other layer or sheet of material preferably is completely hidden within or encapsulated by the plurality of layers or sheets that form the outer wall of the pocket when the sheets are bonded together. This other layer or sheet of material preferably has a thickness greater than the thickness of any one of the plurality of layers or sheets that form the outer wall of the pocket.

Each one of the plurality of layers or sheets that form the outer wall of the pocket preferably are made of a plastic, such as a vinyl material, like polyvinyl chloride or the like. Each one of the elastic bands that form the bottom wall and the sidewalls preferably have a width less than the maximum corresponding extent of the outer wall of the pocket. Where an additional layer or sheet is employed between the layers or sheets that form the outer wall of the pocket, the additional layer or sheet preferably is made of a foam, such as an open cell or closed cell foam.

In a preferred method of making such a bonded pocket assembly, a portion of each sidewall and the bottom wall is placed so it overlies one of the layers or sheets that form the outer pocket wall. Where an additional layer is disposed between the layers or sheets that form the outer pocket wall, the additional layer is placed so it also overlies the same layer or sheet upon which a portion of each sidewall and bottom wall is placed. Thereafter, the other one of the sheets or layers that forms the outer pocket wall is placed on top and these components are bonded together by applying heat and preferably pressure to heat seal them.

In one preferred implementation of the method, one end of the bottom wall and one end of each sidewall is placed so it overlies one of the layers or sheets that form the outer pocket wall. The other one of the layers or sheets that form the outer pocket wall is placed so it overlies these components and heat and pressure is applied to heat seal them together. Preferably, during heat sealing, at least some of one or both layers or sheets that form the outer pocket wall used to a portion of the bottom wall and each sidewall so that the elastic material of the bottom wall and each sidewall positively bonds to the outer wall, forming a the bonded pocket assembly that is durable, strong, and of long-lasting construction. Where an additional layer is to be included between the layers that form the outer pocket wall, the additional layer preferably is placed such that it does not contact any bottom wall or sidewall end.

In another preferred implementation of the method, a plurality of bonded pocket assemblies is constructed substantially simultaneously in a single heat sealing operation. Each pocket assembly is arranged in a manner in accordance with that previously mentioned with one sidewall extending between the outer walls of adjacent pocket assemblies. Thereafter, heat and pressure are preferably applied to heat seal the plurality of pocket assemblies substantially simultaneously. In this manner, at least one row or column of pocket assemblies can be substantially simultaneously produced. In a still further preferred implementation, more than one row or more than one column of pocket assemblies can be substantially simultaneously produced in this manner.

It is an object of the invention to provide a seat construction with improved safety, function, comfort and appearance while advantageously reducing production costs.

It is an object of the present invention to provide a portfolio with one or more article holding boards that are removable and reversible while carrying at least one article disposed on the side of the board toward the panel of the portfolio to which the board is attached.

It is an object of the present invention to provide a portfolio that is versatile, easy to use, flexible, and durable.

It is an object of the present invention to provide a portfolio having at least one article holding board that has a plurality of pockets on one side of the board configured to hold one size or type of article and that has a plurality of pockets on the other side of the board configured to hold another size or type of article.

It is an advantage of the present invention to provide a portfolio that has at least one article holding board that is quickly and easily removable and reversible and which is securely attachable to the portfolio.

It is another advantage of the present invention to provide a portfolio that has at least one article holding board capable of holding one or more articles on both sides of the board that is quickly and easily removable and reversible.

It is an object of the present invention to provide an expandable pocket assembly that is of stitch-less construction.

It is an advantage of the present invention to provide an expandable pocket assembly comprised of one or more sidewalls and/or a bottom wall made of elastic that is quickly and inexpensively constructed without stitching.

Other objects, features and advantages of the present invention include one or more of the following: providing a portfolio that is lightweight, easy to use, of compact construction, of simple construction, economical to make, easier and faster to assemble, convenient to package and ship, is more versatile and adaptable, and which is durable, robust and reliable.

Other objects, features and advantages of the present invention also include one or more of the following: providing a pocket arrangement that is fast and economical to make, of simple construction, is strong, tough and long lasting, is easier and faster to assemble, and which is durable, robust and reliable.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate the best mode currently contemplated of practicing the present invention. One or more preferred exemplary embodiments of the invention are illustrated in the accompanying drawings in which like reference numerals represent like parts throughout and in which.

Figure 1:
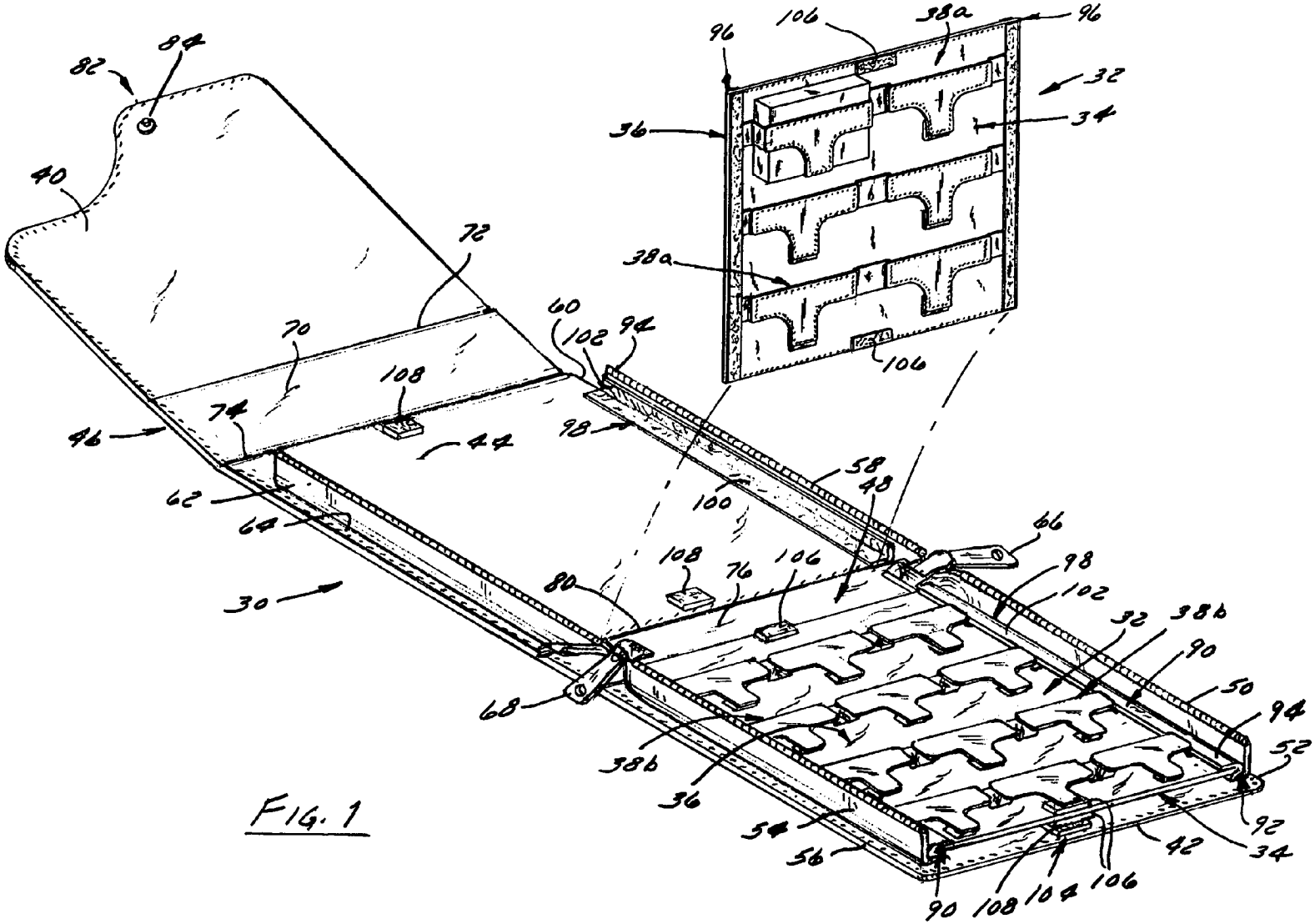
FIG. 1 is a perspective view of an opened portfolio constructed according to the present invention with a removable and reversible article holding board exploded therefrom.

Before explaining one or more embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF AT LEAST ONE PREFERRED EMBODIMENT

Figure 2:
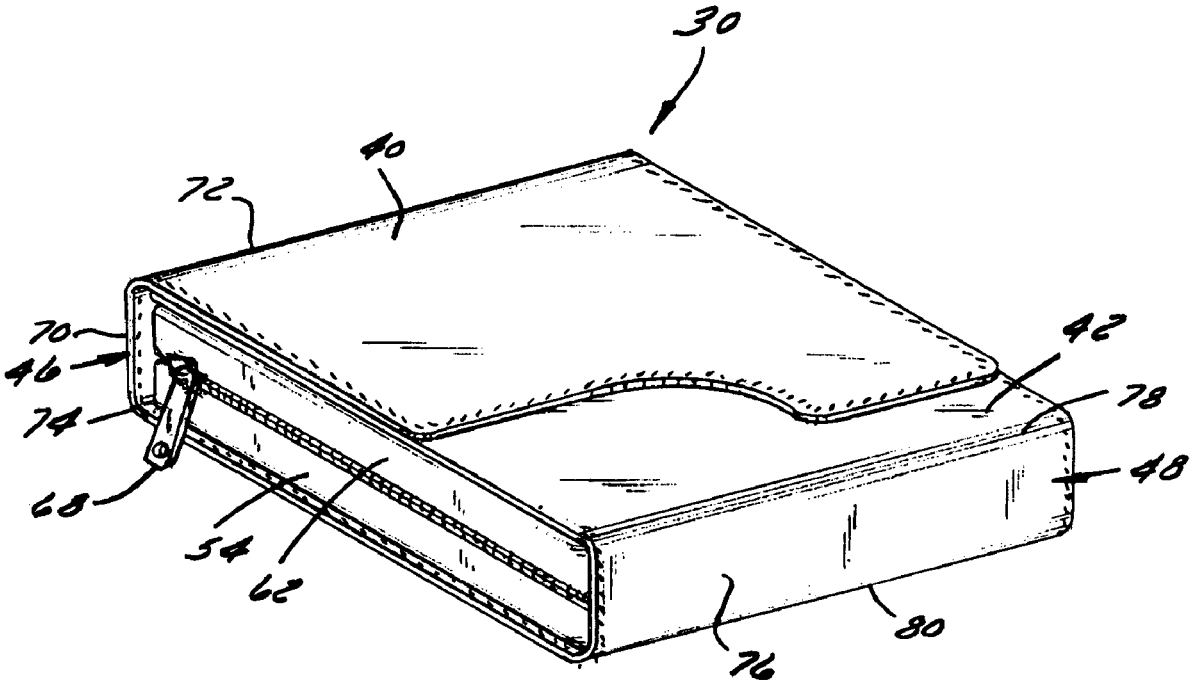
FIG. 2 is perspective view of the portfolio of FIG. 1 closed.

FIGS. 1 and 2 illustrate a preferred embodiment of a portfolio 30, configured in this preferred but exemplary embodiment as a case, which is equipped with a plurality of article holding boards 32, each of which is removable and reversible. Each article holding board 32 has a front surface 34 and a back surface 36 that each carries a plurality of article holding pockets 38*a* and 38*b*. If desired, the portfolio 30 can be configured as a binder (not shown), whether or not configured as a case. If desired, the portfolio 30 can also be equipped with one or more two or three ring binder assemblies (also not shown).

The portfolio 30 has a plurality of cover panels with one of the cover panels foldable relative to another one of the cover panels. In the preferred embodiment shown in FIGS. 1 and 2, the portfolio 30 has three cover panels 40, 42, and 44 with two of the cover panels 40 and 42 being outer cover panels. A first one of the outer cover panels 40 is attached by a first hinge arrangement 46 to a middle cover panel 44 and a second one of the outer cover panels 42 is attached by a second hinge arrangement 48 to the middle cover panel 44.

The first hinge arrangement 46 preferably includes a first spine 70 that is attached to outer cover panel 40 by a first hinge 72 and that is attached by a second hinge 74 to the middle cover panel 44. As is shown more clearly in FIG. 2, the second hinge arrangement 48 preferably includes a second spine 76 that is attached to outer cover panel 42 by a third hinge 78 and that is attached by a fourth hinge 80 to the middle cover panel 44.

One of the article holding boards 32 is removably and reversibly attached to outer cover panel 42 and the other one of the article holding boards 32 is removably and reversibly attached to middle cover panel 44. Each article holding board 32 can be oriented with its front surface 34 toward a user who has opened the portfolio 30 to present a plurality of pairs of article holding pockets 38*a* so they, along with any pocketed article, are each accessible to the user. Each article holding board 32 can be reversed or flipped around such that its rear surface 36 is disposed toward the user to present a plurality of pairs of article holding pockets 38*b* so they, along with any pocketed article, are each accessible to the user. This can be done even if the pockets 38*a* and 38*b* on both surfaces 34 and 36 each contain an article.

Each article holding board 32 is capable of releasably engaging a corresponding one of the cover panels 42 and 44 in a manner that enables the board 32 to be releasably retained in place no matter which surface 34 or 36 of the board 32 is facing toward the particular cover panel releasably retaining it. To releasably retain each board 32, there is a region of releasable engagement 90 between the board 32 and its corresponding cover panel along or adjacent at least one edge of the board 32. Preferably, there is plurality of such releasable engagement regions 90 with one region of releasable engagement 90 being located along or adjacent one edge of the board 32 and the other region of releasable engagement 90 being located along or adjacent the other edge of the board 32. Preferably, the releasable engagement regions are constructed and arranged to allow each board 32 to be releasably retained no matter which surface 34 or 36 is disposed toward or away from the cover panel 42 or 44 releasably retaining it.

Referring additionally to FIGS. 3-6, each region of releasable engagement 90 preferably is defined by a fastening arrangement 92 that includes at least one piece of a hook and loop fastening material 94, such as VELCRO or the like, carried by the cover panel 42 and/or 44 which releasably engages a corresponding piece of hook and loop fastening material 96 carried by the board 32. In a currently preferred embodiment, one or more pieces of hook and loop fastening material are preferably carried by or comprise a flap 98.

Preferably, there is a piece of hook and loop fastening material 96 disposed along each side edge of each article holding board 32. Likewise, there also is a piece of hook and loop fastening material 94 disposed along each side edge of each cover panel 42 and 44. Where flaps 98 are used, a flap 98 preferably is disposed along each side edge of each cover panel 42 and 44.

Preferably, each piece of hook and loop fastening material 94 and 96 is of elongate construction. Likewise, each flap 98 preferably also is elongate. Preferably, each piece of hook and loop fastening material 96 extends substantially the full length of the side edge of the article holding board 32 to which it is attached. Likewise, each flap 98 and its hook and loop fastening material, preferably also extend substantially the full length of the side of the cover panel 42 and/or 44 to which it is attached.

Each flap 98 preferably has a first leg 100 used to anchor the flap 98 and a second leg 102 that extends outwardly from the first leg 100. Where the flaps 98 are attached to the cover panels 42 and 44, the first leg 100 of each flap 98 is fixed to part of its corresponding cover panel, preferably to the inner cover panel surface adjacent or along one of the side edges of the cover panel. The second leg 102 is not attached to any part of its corresponding cover panel. At least one leg 100 or 102 of each flap carries or comprises hook and loop fastening material. In a currently preferred embodiment, both legs 100 and 102 carry or comprise hook and loop fastening material.

Each flap 98 preferably is made of a flexible material, such as cloth, fabric or the like. Each flap 98 preferably is formed of a hook and loop fastening strip or tape of one piece and unitary construction that is attached along its first leg 100 to a corresponding cover panel 42 or 44. The first leg of each flap preferably is fixed to its respective cover panel such as by bonding, stitching, riveting, or in another manner. In one preferred embodiment, the first leg 100 of each flap is adhesively bonded to its respective cover panel. Each strip of hook and loop fastening material 96 carried by each article holding board 32 preferably is fixed to the board in a like manner.

There can be at least one other fastening arrangement 104 disposed between the releasable engagement strips 96 of each board 32 and the releasable engagement strips 94 of the cover panel 42 or 44 that also can help with releasable engagement between each board 32 and its corresponding cover panel 42 or 44. In the preferred embodiment shown in the drawing figures, there is a plurality of fastening arrangements 104 disposed therebetween. Each such fastening arrangement 104 preferably includes a piece of hook and loop fastening material 106 carried by the board 32 that can releasably engage a piece of hook and loop fastening material 108 carried by the corresponding cover panel 42 or 44. As is shown in FIG. 1, there is one set of releasably engageable hook and loop fastener pieces 106 and 108 disposed along one side of the board 32 and corresponding cover panel 42 or 44 that extends between their side edges and a second set of releasably engageable hook and loop fastener pieces 106 and 108 disposed along the other side of the board 32 and corresponding cover panel 42 or 44.

Figure 6:
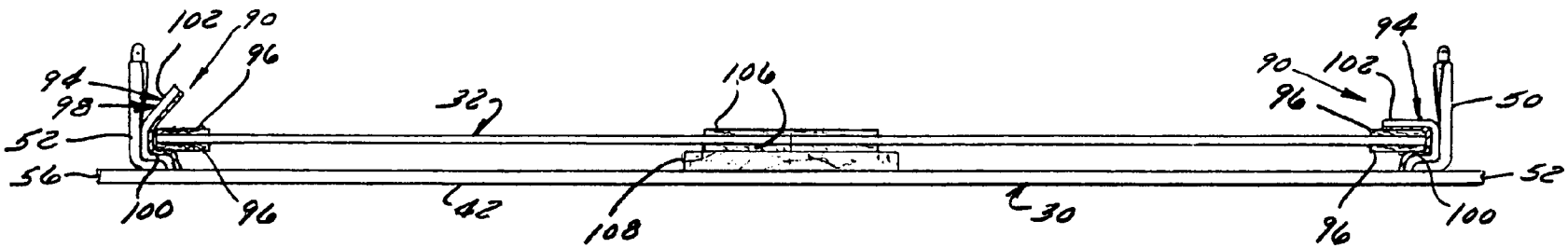
FIG. 6 is an end view of the portfolio depicting the article holding board releasably attached to a panel of the portfolio.

FIG. 6 shows an article holding board 32 releasably attached to cover panel 42. Each fastener strip 94 of the cover panel 42 is releasably engaged with a corresponding fastener strip 96 of the board 32. The outer leg 102 of the right hand side strip 94 is wrapped around and releasably engaged with a corresponding strip of hook and loop fastening material 96 that lies on the surface of the board 32 facing away from the cover panel 42. The inner leg 100 of each strip 94 is releasably engaged with a corresponding strip of hook and loop fastening material 96 that lies on the surface of the board 32 facing toward the cover panel 42. The top and bottom pieces of hook and loop fastening material 106 on the board 32 are engaged with a corresponding piece of hook and loop fastening material 108 on the cover panel 42.

To remove the board 32, the outer leg 102 of each strip of hook and loop fastening material 94 of the cover panel 42 is disengaged from the strip of hook and loop fastening material 96 of the board 32 with which it had been engaged. To do so, each outer leg 102 is disengaged by peeling it away from strip 96. For example, the left hand side outer leg 102 is shown in FIG. 6 peeled away and disengaged from strip 96.

After both outer legs 102 have been disengaged, the board 32 is grasped, such as along at least one side edge, and pulled away from the cover panel 42. Enough force is applied at a suitable angle to cause each strip of hook and loop fastening material 96 to disengage from its corresponding inner leg. In at least some situations, it may be desirable to apply a separation force along one side of the board 32 so as to disengage at least a portion of one of the strips 96 from its corresponding inner leg 100 before applying separation force along the other side of the board 32.

After the board 32 has been removed, it can be flipped around and reversed before putting it back. As a result, the board 32 can be easily positioned with either surface facing outwardly away from the cover panel to which it is attached so that any article carried by that surface of the board 32 is conveniently accessible to the user when the portfolio 30 is opened.

When putting the board 32 back, the outer leg 102 of each fastener strip 94 is urged outwardly to provide clearance to enable the board 32 to be placed with the corresponding fastener strip 96 of the surface facing toward the cover panel 42 in engagement with the inner leg 100 of corresponding fastener strip 94. Thereafter, the outer leg 102 of each fastener strip 94 is wrapped around a corresponding side edge of the board 32 until at least a portion of it engages a corresponding fastener strip 96 on the surface of the board 32 facing away from the cover panel 42.

Each outer leg 102 extends outwardly a sufficient distance to permit a board 32 with one or more articles received in a corresponding number of pockets 38*a* or 38*b* on one surface of the board 32 to releasably retain the board 32 with that surface of the board 32 disposed toward the cover panel. As a result, the pockets on both surfaces 34 and 36 of the board 32 can carry articles with the board 32 being releasably attachable to a corresponding cover panel 42 or 44 with either surface 34 or 36 facing toward the cover panel.

Where the portfolio 30 is configured as a case, the second outer cover panel 42 has a first skirt 50 extending along one side edge 52 and a second skirt 54 extending along the other side edge 56 with the skirts 50 and 54 preferably being generally parallel. The middle cover panel 44 also has a third skirt 58 extending along one side edge 60 and a fourth skirt 62 extending along the other side edge 64 with the skirts 58 and 62 also preferably being generally parallel. Each skirt 50, 54, 58, and 62 preferably is made of a flexible, tough and durable material, such as nylon, leather, or another such suitable material.

The first skirt 50 of the outer cover panel 42 is releasably attached to the third skirt 58 of the middle cover panel 44 by a first attachment arrangement 66 that preferably is a zipper. Likewise, the second skirt 54 of the outer cover panel 42 is releasably attached to the fourth skirt 62 of the middle cover panel 44 by a second attachment arrangement 68 that preferably also is a zipper.

Referring once again to FIG. 2, the portfolio 30 can be closed by folding the outer cover panel 42 over the middle cover panel 44 and folding the outer cover panel 40 over the other two panels 42 and 44. Where configured as a case, the first zipper 66 is moved from adjacent hinge arrangement 48 to adjacent hinge arrangement 46 releasably join the first skirt 50 to the third skirt 58 and the second zipper 68 is moved from adjacent hinge arrangement 48 to adjacent hinge arrangement 46 releasably join the second skirt 54 to the fourth skirt 62.

A latch arrangement 82 preferably is used to releasably close the first outer cover panel 40 against the second outer cover panel 42. In the preferred embodiment shown in FIGS. 1 and 2, the latch arrangement 82 includes a snap 84 carried by the first outer cover panel 40 that releasably engages a snap receiver (not shown) carried by the second outer cover panel 42 to releasably keep the first outer cover panel 40 closed against the second outer cover panel 42. The snap 84 or snap receiver (not shown) can be of magnetic construction to help keep these two components engaged when the first outer cover panel 40 is closed against the second outer cover panel 42. A friction fit preferably is provided between the snap 84 and snap receiver to releasably retain the snap 84 in releasable engagement with the snap receiver when the first outer cover panel 40 is closed against the second outer cover panel 42.

Figure 3:
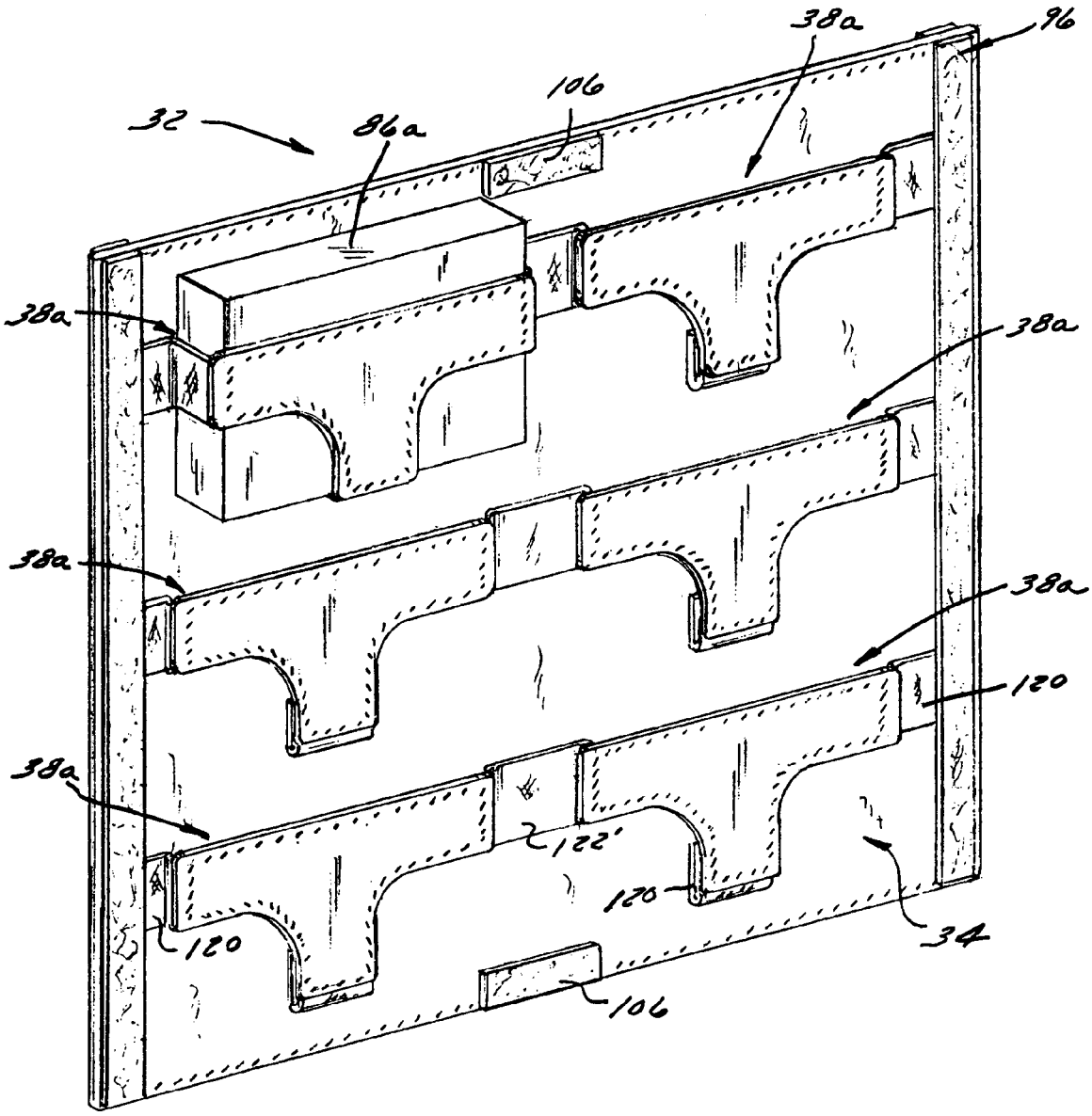
FIG. 3 is a perspective view of one side of the article holding board of FIG. 1.
Figure 4:
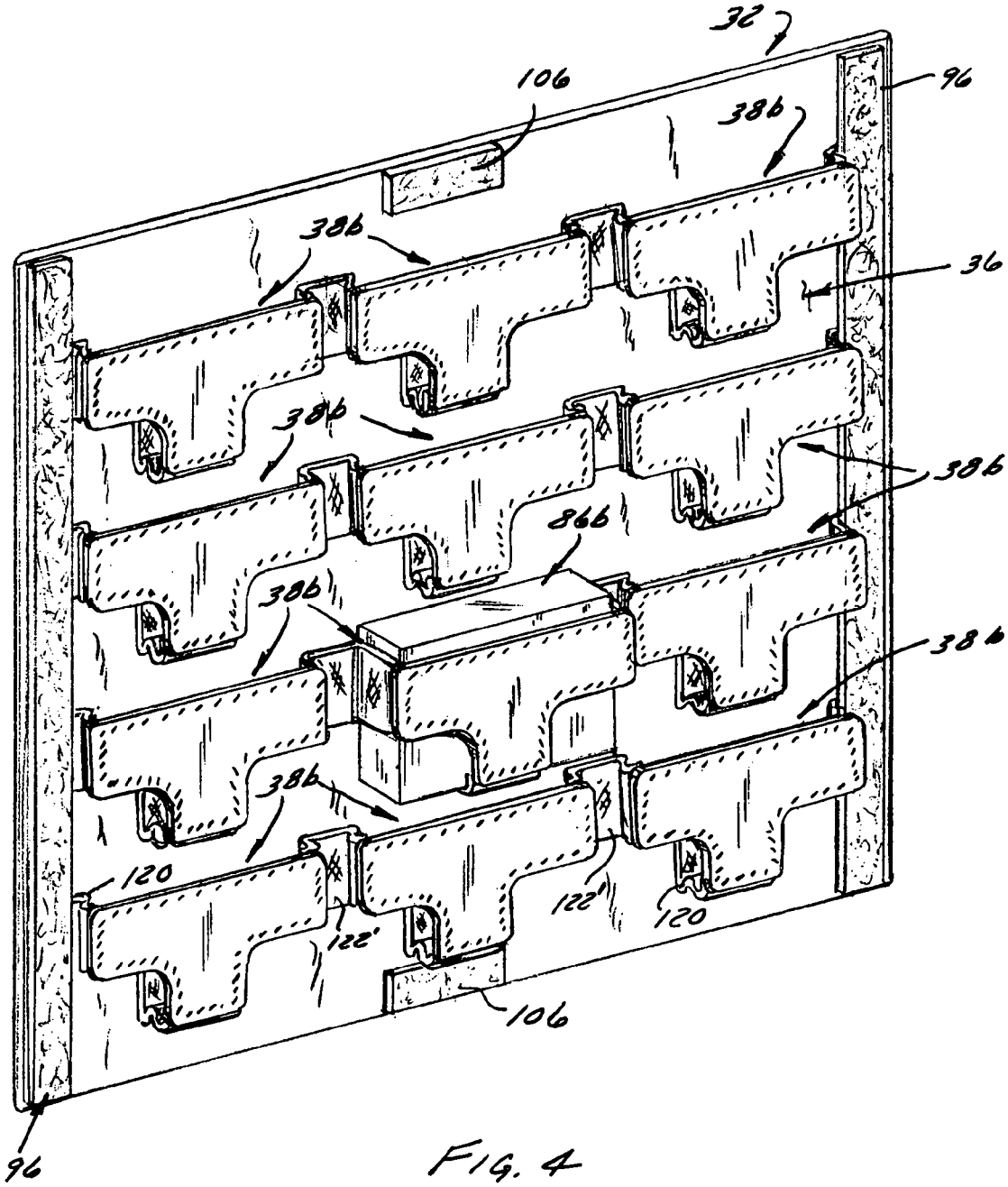
FIG. 4 is a perspective view of the other side of the article holding board of FIG. 1.

FIGS. 3 and 4 illustrate a preferred embodiment of an article holding board 32 that has been removed from the portfolio 30. FIG. 3 illustrates one side 34 of the article holding panel 32 that is equipped with a plurality of pairs of spaced apart article holding pockets 38*a*. The article holding pockets 38*a* preferably are arranged in an array that includes a plurality of rows of pockets 38*a* and a plurality of columns of pockets 38*a*.

FIG. 4 illustrates the other side 36 of the article holding panel 32, which also is equipped with a plurality of pairs of spaced apart article holding pockets 38*b*. The article holding pockets 38*b* preferably are also arranged in an array that includes a plurality of rows of pockets 38*b* and a plurality of columns of pockets 38*b*.

In the preferred embodiment of the article holding panel 32 shown in FIGS. 3 and 4, each article holding pocket 38*a* is constructed and arranged to hold a first article 86*a* (FIG. 3) of one size and each article holding pocket 38*b* is constructed and arranged to hold a second article 86*b* (FIG. 4) of a size that is different than that of the first article 86*a*. In the preferred embodiments shown in FIG. 3 and 4, the articles 86*a* and 86*b* comprise media, such as recording media, storage media, or the like, which preferably is configured in tape, disk, cartridge or cassette form. Each article 86*a* and 86*b* preferably also includes an outer case, jacket, or the like, respectively identified by reference numerals 88*a* and 88*b*, in which media is removably retained and which can be of clamshell, jewel case, hinged cassette box, or library case construction.

In a currently preferred embodiment, each article holding pocket 38*a* and 38*b* is respectively constructed and arranged to each removably hold an article 86*a* and 86*b* that is a cassette (not shown), each of which is respectively received in a hinged cassette box 88*a* and 88*b* of known construction. In a currently preferred embodiment, one surface 34 of the article holding panel 32 has pockets 38*a* configured to hold eight millimeter cassettes, such as Hi8 eight millimeter cassettes, and the other surface 36 of the panel 32 has pockets 38*b* configured to hold Mini DV cassettes. If desired, one or both surfaces 34 and/or 36 of each article holding panel 32 can be configured to hold other articles, such as, for example, four millimeter cassettes, digital-audio tape cassettes, DLT tape cartridges, LTO tape cartridges, or the like.

In another preferred embodiment, an article holding board 32 made in accordance with the invention has article holding pockets on both surfaces 34 and 36 that are constructed and arranged to hold the same type and size article (not shown). If desired, an article holding board constructed in accordance with the invention can also be constructed and arranged such that one or both surfaces can hold articles of different sizes and/or different types.

Figure 5:
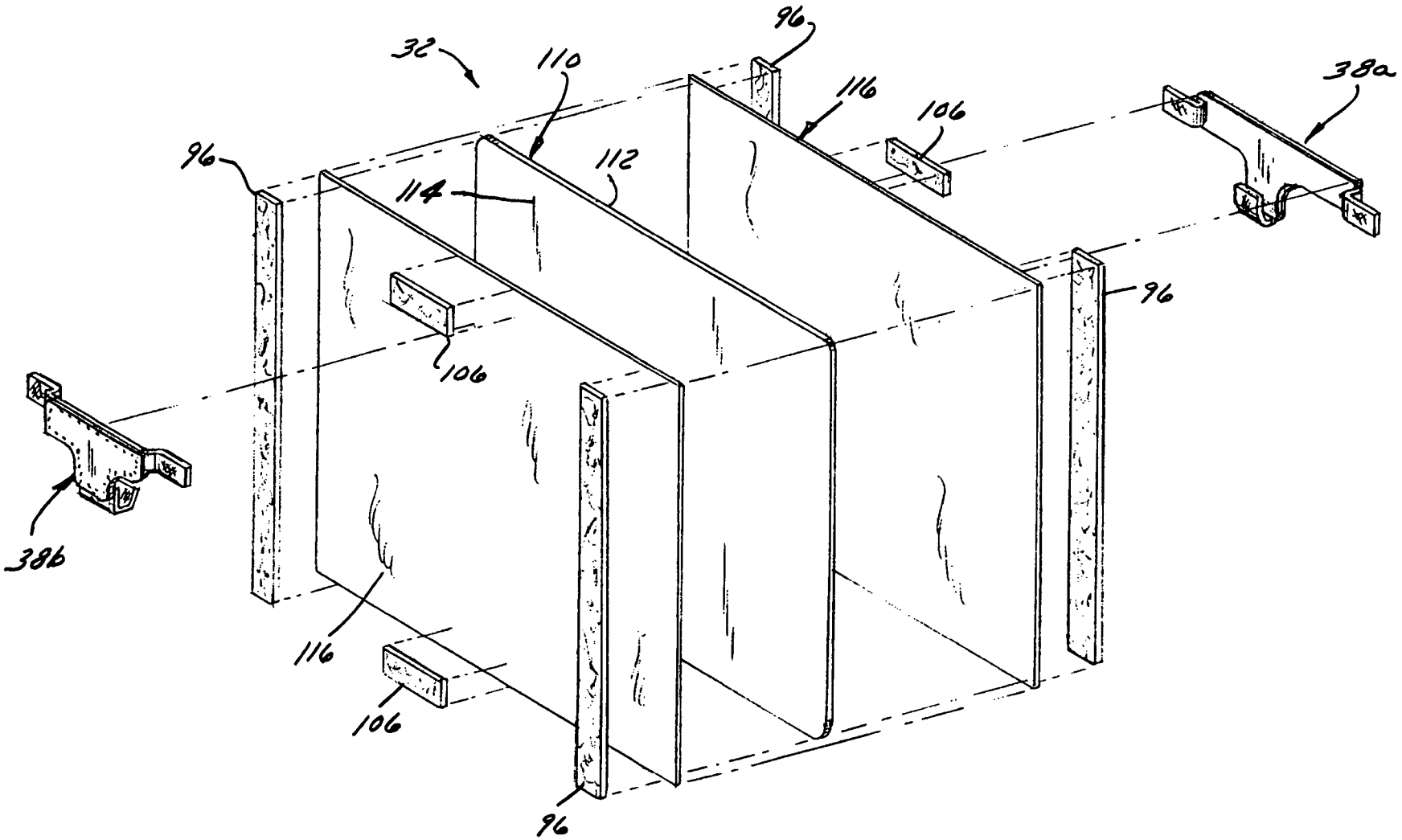
FIG. 5 is a perspective exploded view of the article holding board of FIG. 1.

Referring additionally to FIG. 5, a preferred construction of a preferred embodiment of the article holding board 32 of FIGS. 3 and 4 is depicted. The board 32 has a backing 110 that preferably is constructed of a relatively rigid and durable material, such as Kraftboard, plastic, or the like. The front and back surfaces 112 and 114 of the backing 110 preferably are covered with a material, such as a plastic (such as vinyl or the like), leather, cloth, fabric, or some other material. In the preferred embodiment shown in FIG. 5, both surfaces 112 and 114 have such an outer covering 116 attached thereto. Each outer covering 116 preferably is fixed to the backing 110, such as by being bonded to the backing 110, by being stitched to the backing 110, or by being attached in some other manner.

Figure 7:
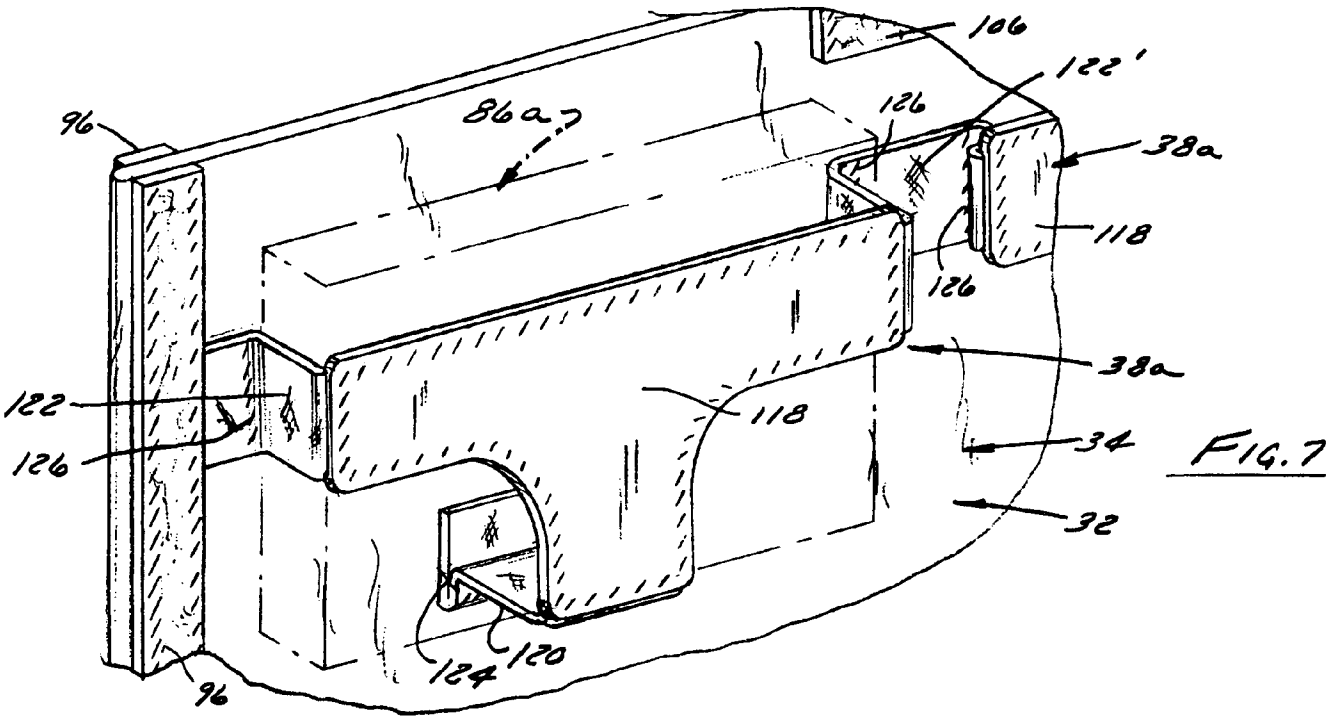
FIG. 7 is an enlarged fragmentary perspective view of part of the board of FIG. 1.
Figure 8:
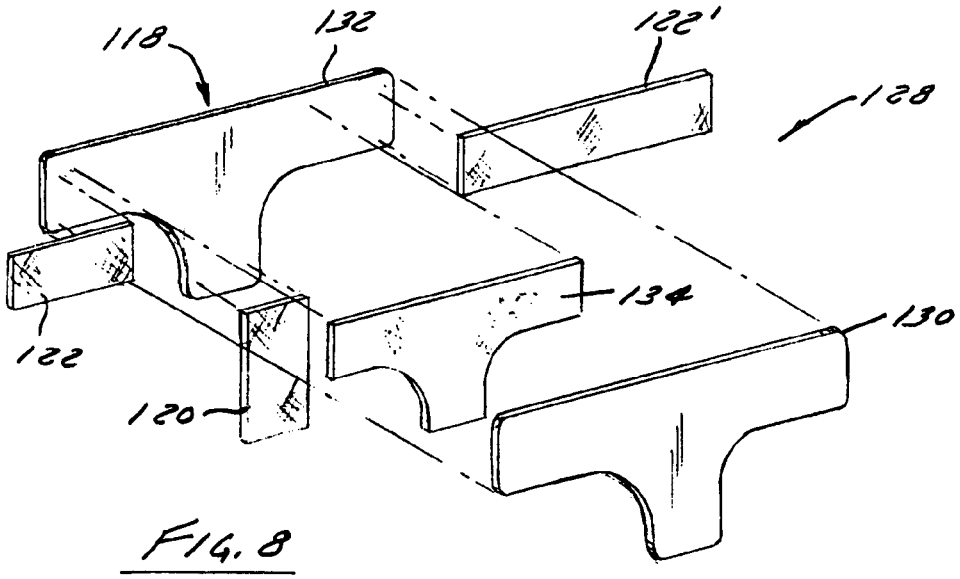
FIG. 8 is an exploded perspective view of an article holding pocket constructed in accordance with the present invention.
Figure 9:
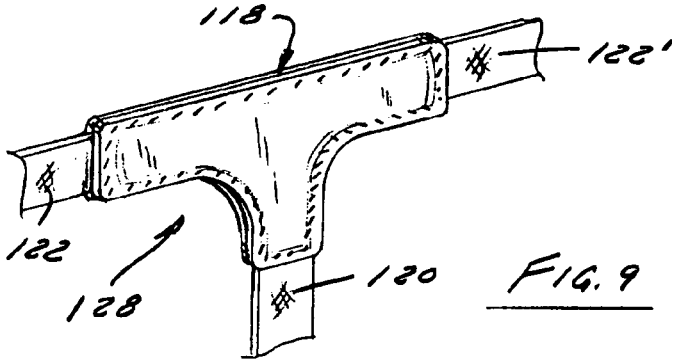
FIG. 9 illustrates an enlarged fragmentary view of the pocket of FIG. 8.

FIGS. 7-9 illustrate a preferred embodiment of an article holding pocket 38*a* in more detail. However, the below presented disclosure also applies to article holding pocket 38*b*, as it is essentially the same in construction, but of a different size.

Referring to FIG. 7, the article holding pocket 38*a* is generally T-shaped, but can have a different shape if desired. The pocket is defined by an outer wall 118 that overlies an article in the pocket 38*a*, a bottom wall 120 that underlies the article, and a pair of spaced apart sidewalls 122 and 122'. Sidewall 122 is similar to sidewall 122' except that sidewall 122' is longer and extends from one pocket 38*a* to an adjacent pocket 38*a*. The bottom wall 120 and sidewalls 122 and 122' are preferably fixed to the article holding board 32 with the outer wall 118 extending from the bottom wall 120 and between the sidewalls 122 and 122'. The bottom wall 120, sidewalls 122 and 122', outer wall 118, and part of the article holding board 32 collectively define a cavity, i.e. a pocket, that releasably accepts and retains an article 86*a* (shown in FIG. 7 in phantom) therein, such as a cassette disposed in its box.

The bottom wall 120 and sidewalls 122 and 122' are made of a flexible material that preferably also is stretchable. In one preferred embodiment, the bottom wall 120 and the sidewalls 122 and 122' are each made of an elastomeric material. Each preferably is made of an elastic band that can be narrower than the corresponding dimension of the outer pocket wall 118. The bottom wall 120 preferably is attached at or adjacent its free end by a line of stitching 124 that preferably extends generally transverse to the wall 120. Likewise, each sidewall 122 and 122' is also attached by a transversely extending line of stitching 126.

FIG. 8 illustrates an exploded view of a preferred embodiment of an assembly 128 of the pocket 38*a* shown in FIG. 7. The bottom wall 120 and sidewalls 122 and 122' are each made of a separate length of elastic band that is sandwiched between an outer layer 130 and an inner layer 132 that define a preferred embodiment of the outer wall 118. Each layer 130 and 132 preferably are also generally T-shaped and of complementary construction such that they are identical or nearly identical to each other in shape and size. In a currently preferred embodiment, there also is a middle layer 134 disposed adjacent the ends of the bottom wall 120 and the sidewalls 122 and 122' and between the outer layer 130 and inner layer 132. While the middle layer 134 also is generally T-shaped, it is smaller than both the outer layer 130 and the inner layer 132 such that it is completely hidden from view inside the outer wall 118 when pocket assembly is completed.

The outer layer 130 and the inner layer 132 are made of a somewhat flexible and durable material that preferably is comprised of plastic. One preferred material is polyvinyl chloride (PVC). The outer layer 130 and inner layer 132 preferably are bonded to a part of the bottom wall 120 and a part of each sidewall 122 and 122' that is located between the layers 130 and 132 to fix the bottom wall 120 and sidewalls 122 and 122' to the outer pocket wall 118 when assembly is completed. Preferably, the outer layer 130 and inner layer 132 are also bonded to each other. In one preferred embodiment, the two layers 130 and 132 are bonded to each other along their outer periphery where not bonded to the bottom wall 120 and the sidewalls 122 and 122'.

If desired, one or both layers 130 and/or 132 can also be bonded to the middle layer 134. The middle layer 134 preferably is comprised of a foam material, such as an open cell or closed cell foam, which can be made of PVC. The middle layer 134 preferably is thicker than the outer layer 130 and the inner layer 132. Where such a middle layer 134 is used, the increased thickness of the middle layer 134 helps improve the aesthetic appearance of the outer pocket wall 118, particularly when its outer layer 130 is configured to provide a leather-like or simulated leather appearance.

Figure 10:
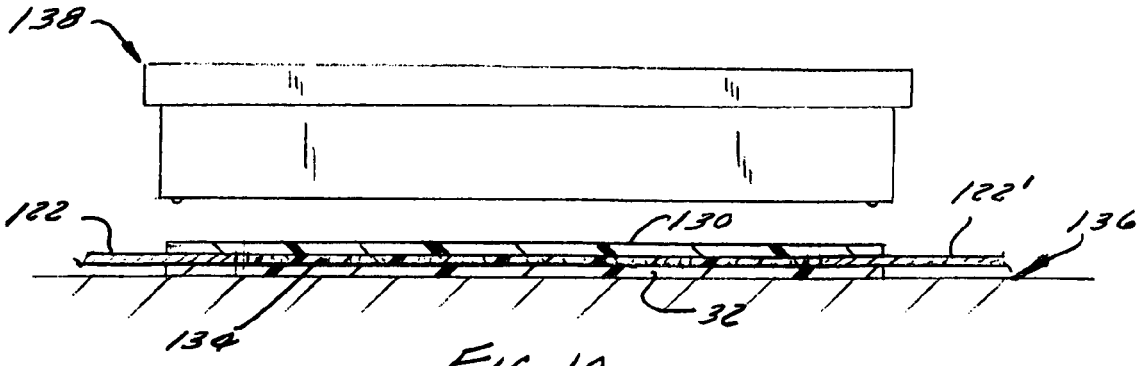
FIG. 10 illustrates a side elevation view of a fixture assembly for forming a pocket constructed in accordance with the invention.

Referring additionally to FIGS. 9 and 10, in accordance with a method of the invention, the pocket assembly 128 is made by bonding the aforementioned components, including the outer and inner layers 130 and 132, the bottom wall 120, and the sidewalls 122 and 122'. Preferably, bonding is achieved by heat sealing using this novel method, the steps of which are described in more detail immediately following.

In assembly, one end of the bottom wall 120 and each sidewall 122 and 122' is placed on the inner surface of either the outer layer 130 or the inner layer 132 such that at least part of the bottom wall 120 and each sidewall 122 and 122 overlaps that layer. Where a middle layer 134 is employed, the middle layer 134 is placed on the same layer 130 or 132, preferably between the free end of the bottom wall 120 and the free end of both sidewalls 122 and 122' such that they preferably do not touch the middle layer 134. Thereafter, the remaining layer 130 or 132 is placed on top with its inner surface disposed toward, and preferably against, at least part of the bottom wall 120 and each sidewall 122 and 122' as well as the middle layer 134 (where a middle layer is employed).

After assembly, heat is applied to bond these components 120, 122, 122', 130 and 132, together to produce the pocket assembly 128 shown in FIG. 9. Preferably, pressure is also applied to help facilitate bonding. Routine testing and experimentation can be performed to determine suitable temperatures and pressures to use to bond the components together. For example, at least one or both layers 130 and/or 132 of the unbonded pocket assembly 128 are preferably heated to a temperature of at least 200° F. during bonding. For example, a pressure of at least two hundred pounds per square inch preferably is applied during bonding. Routine testing and experimentation can also be performed to determine how long to apply heat and pressure in order to suitably bond the components together.

FIG. 10 illustrates the components of the pocket assembly 128, namely, the outer and inner layers 130 and 132, each sidewall 122 and 122', and the middle layer 134 arranged before bonding on a holding fixture 136, which can be a tray, table, or the like, in accordance with the aforementioned method steps. An upper fixture 138 is depicted in FIG. 10 as overlying the holding fixture 136 with the aforementioned components of the pocket assembly 128 lying on the holding fixture 136.

During the bonding process, relative movement between the upper fixture 138 and holding fixture 136 brings the fixtures 136 and 138 together. Heat is applied, along with pressure, for a sufficient amount of time until bonding occurs. Thereafter, the fixtures 136 and 138 are separated and the bonded pocket assembly 128 removed.

Heating preferably is achieved using a heating element (not shown) that preferably is carried by or integral with one or both fixtures 136 and 138. The heating element preferably is an electrically resistive heating element. If desired, the heating element can be constructed and arranged, for example, to ultrasonically heat one or more of the components 120, 122, 122', 130 and/or 132 of the pocket assembly 128. Other types of heating elements or heat sources can also be used to heat of the components of the pocket assembly 128.

Pressure preferably is generated using a press (not shown) that is connected to one or both fixtures 136 and 138. Such a press preferably includes a drive (not shown), which can be of electrical, pneumatic, or hydraulic construction. The drive is constructed and arranged to enable the fixtures 136 and 138 to be moved relative one another toward and away from each other. For example, in one preferred embodiment, the press includes a drive used to urge the upper fixture 138 against the holding fixture 136 to bond the components of the pocket assembly 128 and thereafter to move the upper fixture 138 away from the holding fixture 136 so the bonded pocket assembly 128 can be removed. A pneumatic drive preferably is employed where fast cycle times are desired. Where greater pressure is desired, a hydraulic drive preferably is employed.

One or both fixtures 136 and 138 can be constructed and arranged to impress a three dimensional contour onto at least one of the layers 130 and/or 132 that form the outer pocket wall 118 during bonding. For example, one of the fixtures, such as upper fixture 138, preferably is three dimensionally contoured to impress a simulated stitching line into the outer surface of the outer layer 130 of the outer pocket wall 118 during bonding. If desired, one or both fixtures 136 and 138 can also be used to trim one or more of the components of the pocket assembly 128 during bonding.

To help facilitate bonding, a bonding agent can be used. For example, parts or the entire inner surface of the outer layer 130 and/or the inner layer 132 can include or comprise a temperature activated adhesive that helps bond the components of the pocket assembly 128 together when heat and/or pressure is applied. Such an adhesive can be in the form of a coating, powder, or lacquer, such as a heat sealing lacquer. Sufficient heat is applied in order to bring the temperature up to or above the activation temperature of the adhesive. Curing preferably can occur upon cooling.

As a result, the cost to produce each pocket 38*a* is dramatically reduced as the components that make up each pocket assembly 128 are not stitched together. This saves a great deal of time because each pocket assembly 128 can be heat sealed in a manner of a manner of a minute or two, preferably in less than one minute. This reduces labor costs, as very little labor is required using this method.

In a preferred implementation of this method of the invention, a plurality of pocket assemblies 128 is substantially simultaneously bonded in a single bonding operation using fixtures suitably modified in size. In one preferred implementation, a single row of pocket assemblies 128 is substantially simultaneously bonded in a single bonding operation. If desired, a plurality of such rows of pocket assemblies 128 can be bonded in a single bonding operation.

In preparation for bonding, one pocket wall layer 130 or 132 of each pocket assembly 128 is placed on a holding fixture, similar to holding fixture 136, such that the pocket assemblies 128 lie adjacent one another in a line. An end of the bottom wall 120 and each sidewall 122 and 122' of each pocket assembly 128 are placed on its corresponding layer 130 or 132 with one of the sidewalls 122' extending between adjacent pocket assemblies 128 being assembled. Where a middle layer 134 is employed, a middle layer 134 is placed on the corresponding layer 130 or 132 of each pocket assembly 128 being assembled. After that, the remaining layer 132 or 130 is placed over its corresponding pocket assembly 128 of each pocket assembly being assembled.

Heat and preferably pressure are applied substantially simultaneously to all of the pocket assemblies 128. Where fixtures, like those shown in FIG. 10, are used, the fixtures are brought together to apply heat and pressure directly to each pocket assembly 128. When finished, the fixtures are separated, and at least one row of bonded pocket assemblies 128 is removed from the holding fixture. In essentially the same manner, if desired, a plurality of rows of such pocket assemblies 128 can be substantially simultaneously formed.

Thereafter, each bonded pocket assembly 128 is fixed to an article holding board 32 forming a pocket 38*a* therewith. In a currently preferred embodiment, the bottom wall 120 of each pocket assembly 128 is stitched 124 adjacent or along its free end to the article retaining board 32. Preferably, the stitching 124 extends into the backing 110 of the board 32 to positively attach the bottom wall 120 to the board 32. The free end of the bottom wall 120 preferably is a curled upwardly, such as in the manner depicted in FIG. 7, so it underlies the outer pocket wall 118 to help prevent it from being inadvertently caught on something during use and operation.

Each pocket sidewall 122 and 122' preferably is stitched 126 to the article holding board 32 in a similar manner. The free end of sidewall 122 of each outer pocket assembly 128 preferably is disposed between one of the strips of hook and loop fastener material 96 and the article holding board 32. As a result, no free end of any sidewall 122 of any pocket assembly 128 is exposed, also helping to prevent it from being inadvertently caught on something during use and operation.

Modifications falling within the scope of the invention are contemplated. For example, if desired, at least one hook and loop fastener strip 96 extending along each side edge of board 32 can be modified so as to extend outwardly beyond its adjacent side edge of the board 32. If desired, each hook and loop fastener strip 96 so modified can be wrapped around a corresponding side edge of the panel 42 and/or 44 with which the board 32 is being releasably attached. In that case, each strip 94 of that panel 42 and/or 44 is placed on the outside panel surface adjacent a corresponding side edge of the panel. Each panel so modified preferably also lacks any skirt to permit each strip 96 so modified to be wrapped around its corresponding panel side edge without being obstructed by any skirt.

It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

I hereby claim:

1. A portfolio comprising: a panel; an article carrying board having a front surface and a rear surface that are both constructed and arranged to carry at least one article; and wherein the board is reversibly and releasably held by the panel further comprising a plurality of article holding pockets carried by each surface of said board wherein each article holding pocket is comprised of an outer pocket wall spaced outwardly from the board that is comprised of a pair of layers of plastic material that are bonded to each other without stitching and bonded without stitching to (a) a bottom pocket wall comprised of elastic that has one end attached to the board, (b) a first pocket sidewall disposed along one side of the article holding pocket that has one end attached to the board, and (c) a second pocket sidewall disposed along the other side of the article holding pocket that has one end attached to the board.

2. The portfolio of claim 1 wherein the other end of the bottom wall is disposed between the pair of layers of plastic that form the outer pocket wall and bonded therewith and the other end of each sidewall is disposed between the pair of layers of plastic that form the outer pocket wall and bonded therewith.

3. A portfolio comprising: a plurality of panels with one of the panels being movable relative to the other one of the panels; a plurality of article carrying boards that each have a front surface and a rear surface each carrying at least one article holding pocket; a plurality of spaced apart strips of hook and loop fastening material carried by each one of the surfaces of each board with one of the hook and loop strips disposed adjacent one side edge of the board and the other one of the hook and loop strips disposed adjacent the opposite side edge of the board; and a plurality of spaced apart strips of hook and loop fastening material carried by each one of the panels with one of the hook and loop fastening strips of one panel releasably engageable with one of the hook and loop fastening strips of one of the boards and the other one of the hook and loop fastening strips of the one panel releasably engageable with the other one of the hook and loop fastening strips of one of the boards and with one of the hook and loop fastening strips of other panel releasably engageable with one of the hook and loop fastening strips of the other one of the boards and the other one of the hook and loop fastening strips of the other panel releasably engageable with the other one of the hook and loop fastening strips of the other one of the boards permitting each board to releasably attached to one of the panels such that each board can be reversed to change which of its front and rear surfaces is disposed toward the panel and away from the panel to which it is releasably attached, wherein at least one of the article holding pockets is comprised of an outer pocket wall spaced outwardly from the board that is comprised of a pair of layers of plastic material that are bonded to each other without stitching and bonded without stitching to (a) a bottom pocket wall comprised of elastic that has one end attached to the board, (b) a first pocket sidewall disposed along one side of the article holding pocket that has one end attached to the board, and (c) a second pocket sidewall disposed along the other side of the article holding pocket that has one end attached to the board.

4. The portfolio of claim 3 wherein the other end of the bottom wall is disposed between the pair of layers of plastic that form the outer pocket wall and bonded therewith and the other end of each sidewall is disposed between the pair of layers of plastic that form the outer pocket wall and bonded therewith.

5. An article holding pocket assembly for a portfolio comprising: a pair of layers of plastic material that define an outer pocket wall when bonded to each other; a first elastic band having a portion of it disposed between the layers of plastic material and bonded thereto without stitching, the first elastic band defining a pocket bottom; and a second elastic band having a portion of it disposed between the layers of plastic material and bonded thereto without stitching, the second elastic band defining at least one pocket side.

6. The pocket assembly of claim 5 wherein the first elastic band is attached to the portfolio at or adjacent one end and a portion of the second elastic band are attached to the portfolio.

7. The pocket assembly of claim 6 wherein the first elastic band is attached to the portfolio by stitching and the second elastic band is attached to the portfolio by stitching.

8. The pocket assembly of claim 5 wherein the layers of plastic material are bonded by heat sealing them to each other and to the portion of the first elastic band and the portion of the second elastic band disposed between the layers of plastic material.

9. The pocket assembly of claim 8 wherein each layer of plastic material is comprised of vinyl.

10. An article holding pocket assembly for a portfolio comprising: a pair of layers of plastic material that define an outer pocket wall when bonded to each other; a first elastic band having a portion of it, including one end, disposed between the layers of plastic material and bonded thereto without stitching, the first elastic band defining a pocket bottom; a second elastic band having a portion of it, including one end, disposed between the layers of plastic material and bonded thereto without stitching, the second elastic band defining one pocket side; and a third elastic band having a portion of it, including one end, disposed between the layers of plastic material and bonded thereto without stitching, the third elastic band defining the other pocket side.

11. The pocket assembly of claim 10 wherein the other end of the first elastic band is attached at or adjacent its other end to the portfolio, the second elastic band is attached to the portfolio, and the third elastic band is attached to the portfolio.

12. The pocket assembly of claim 11 wherein the first elastic band is attached to the portfolio by stitching, the second elastic band is attached to the portfolio by stitching, and the third elastic band is attached to the portfolio by stitching.

13. The pocket assembly of claim 12 wherein the layers of plastic material are bonded by heat sealing them to each other and to the portion of the first elastic band and the portion of the second elastic band disposed between the layers of plastic material.

14. A method of making an article holding pocket assembly comprising: (a) providing first and second layers of material, a first elastic band and a second elastic band; (b) arranging the first elastic band so part of it overlaps part of one of the first and second layers of material adjacent a bottom of the material layer and another part of it extends outwardly beyond the material layer; (c) arranging the second elastic band so part of it overlaps part of one of the first and second layers of material adjacent one side of the material layer with the second elastic band oriented generally perpendicular to the first elastic band and having another part of it extending outwardly beyond the material layer; (d) placing the other one of the first and second layers of material so it overlies the part of each one of the elastic bands that overlap the one of the first and second layers of material and so it overlies the one of the first and second layers of material; and (e) applying heat and pressure to bond the first and second layers of material to each other and to the part of each elastic band disposed between the first and second layers of material.

15. The method of making an article holding pocket assembly of claim 10 further comprising a third layer of material that is arranged so it overlies the one of the first and second layers of material before step (f) and that is disposed between the first and second layers of material after step (f).

16. The method of making an article holding pocket assembly of claim 15 wherein the third layer of material is comprised of an open cell or closed cell foam and has a thickness greater than the thickness of the first layer of material and has a thickness greater than the thickness of the second layer material.

17. The method of making an article holding pocket assembly of claim 16 wherein the first, second and third layers of material are comprised of plastic.

18. The method of making an article holding pocket assembly of claim 17 wherein the first, second and third layers of material are comprised of nylon.

19. A method of making an article holding pocket assembly comprising: (a) providing a plurality of layers of plastic material, a first elastic band and a second elastic band; (b) arranging the first elastic band so one end overlies at least a portion of one layer of plastic material and so part of it extends outwardly beyond the plastic material layer; (c) arranging the second elastic band so one end overlies at least a portion of the one layer of plastic material with the second elastic band oriented generally perpendicular to the first elastic band and having part of it extending outwardly beyond the plastic material layer; (d) arranging the third elastic band so one end overlies at least a portion of the one layer of plastic material with the third elastic band oriented generally perpendicular to the first elastic band and having part of it extending outwardly beyond the plastic material layer in a direction opposite the second elastic band; (e) arranging the other layer of plastic material so it overlies the end of each one of the elastic bands that overlie the one layer of plastic material and so it overlies the one layer of plastic material; and (f) applying heat and pressure to heat seal the layers of plastic material to each other and to the end of each elastic band disposed between the layers of plastic material.

* * * * *